United States Patent [19]

Todd

[11] 4,237,973

[45] Dec. 9, 1980

[54] METHOD AND APPARATUS FOR STEAM GENERATION AT THE BOTTOM OF A WELL BORE

[76] Inventor: John C. Todd, 10646 Marquis, Dallas, Tex. 75229

[21] Appl. No.: 948,436

[22] Filed: Oct. 4, 1978

[51] Int. Cl.[3] ..... E21B 36/00

[52] U.S. Cl. ..... 166/59; 166/302; 122/4 D

[58] Field of Search ..... 166/57, 59, 61, 62, 166/302, 260, 261, 300, 256, 303; 122/4 D

[56] References Cited

U.S. PATENT DOCUMENTS

| | | | |
|---|---|---|---|
| 2,778,610 | 1/1957 | Bruegger | 122/4 D X |
| 2,911,047 | 11/1959 | Henderson | 166/302 X |
| 2,983,259 | 5/1961 | Wittke | 122/4 D |
| 2,997,031 | 8/1961 | Ulmer | 122/4 D |
| 3,110,300 | 11/1963 | Brown et al. | 122/4 D X |
| 3,119,378 | 1/1964 | Marshall | 122/4 D |
| 3,322,195 | 5/1967 | Brown et al. | 166/300 |
| 3,456,721 | 7/1969 | Smith | 166/59 |
| 4,159,743 | 7/1979 | Rose et al. | 166/302 |

*Primary Examiner*—James A. Leppink
*Assistant Examiner*—Richard E. Favreau
*Attorney, Agent, or Firm*—Hubbard, Thurman, Turner, Tucker & Glaser

[57] ABSTRACT

A catalyst containing steam generator is lowered to the formation to be steamed. A packer is set at the upper extension of the generator to retain the steam. Fuel gas and oxidizing gas are passed through the catalyst which causes combustion within the catalyst bed. Water is passed over the heated tube retaining the hot catalyst bed or through the catalyst bed to produce steam.

8 Claims, 4 Drawing Figures

METHOD AND APPARATUS FOR STEAM GENERATION AT THE BOTTOM OF A WELL BORE

BACKGROUND OF THE INVENTION

This invention relates to a downhole steam generator for use in the injection of steam into a hydrocarbon or other mineral containing formation to reduce said mineral's viscosity and provide energy to drive said mineral from the formation.

A reference believed to be relevant to the present invention is U.S. Pat. No. 3,420,300 issued to the present application on Jan. 7, 1969. That patent teaches the use of a catalytic heater in a borehole for heating a subsurface formation.

Hydrocarbon materials can be removed from a hydrocarbon bearing subterranean formation by the injection of steam. In this method of recovery steam is injected into the formation to reduce the hydrocarbon viscosity and to provide a driving medium to force the hydrocarbon to a producing well bore. The producing well bore may be a well, or wells, adjacent the steam injection well or the injection well may be used as the producing well in which case the steam injection would be terminated during the production of hydrocarbons. This latter method of operation is called huff and puff while the former is called steam drive. The recovery of hydrocarbons is accelerated by the reduction of its viscosity such that it will flow more readily to the producing well bores. Recovery of hydrocarbons is also enhanced by the steam distillation of fractions of the hydrocarbons which are moved toward the producing wells.

In carrying out this recovery method, it is necessary to force steam into the formation with sufficient heat energy to substantially heat the formation and hydrocarbons therein. The generation of steam usually has been by the usage of surface boilers with insulated steam lines running from the boiler to the injection wells. Steam passes through tubing within the injection well bore to the hydrocarbon bearing formation where it enters to heat the formation. Many such steam recovery operations now exist, however, the depth to which this method is applicable is generally less than 3000 feet. The heat loss from the steam containing tubing passing through several hundreds of feet of barren formations above the hydrocarbon formation is excessive. At great depth the steam would all be condensed to water and finally cooled to essentially the temperature of the hydrocarbon bearing formation. Thus the injection of steam from the surface to even moderate depths of 3000 to 5000 feet is ineffective in recovering oil by this method. Some attempts have been made to construct downhole steam generators. These have been by electrical heaters or open flame heaters. The electric downhole heaters are of limited capacity and use and are considered too expensive a means to create a sustained amount of steam energy. The open flame heaters have also been of limited capacity and difficult to control and maintain.

SUMMARY OF THE INVENTION

Accordingly it is an object of this invention to provide a simple apparatus and means of creating steam at the bottom of a well bore for immediate injection into a formation containing hydrocarbons.

According to the present invention a concentric tube steam generator containing a porous matrix of catalyst bed material in its lower section is lowered to the hydrocarbon bearing formation. A fuel gas and oxidizing gas mixture are passed through the oxidizing catalyst bed causing oxidation of the fuel. Oxidation promoting catalysts are well known in the process industries such as for example beds containing metals as platinum, palladium, vanadium, iron, titanium, tungsten, copper, chromium, cobalt, aluminum, nickel, manganese, cerium, silicon, silver, molybdenum, tin, tungsten, etc. or combinations of these materials, alone or supported on various porous materials. The oxidizing catalyst is generally not required after the porous bed becomes heated as the heat alone is sufficient to catalyze the oxidation of the fuel. Thus the porous bed would not necessarily contain the oxidation catalyst for example if the combustion were initiated by an electric heater or by chemical means. However the catalyst may only be placed in the region of the porous matrix where the fuel-air mixture first contacts the bed. Thus the catalyst need not be throughout the porous bed; sand, aluminum, glass beads or other inert material may be the bulk of the porous matrix, for example.

In one embodiment of this invention the exhaust gas from the porous bed passes to the surface where a portion of the gas may be recycled with additional fuel and oxygen. Water passes down the annulus between the casing and burner tube and through a porous bed separate from the porous bed containing the burning gases though adjacent to this bed. Heat flows through the pipe wall separating these porous beds to heat the water to vaporize it to steam. Steam then passes out the bottom of the steam generator into the hydrocarbon containing bed. In a second embodiment of this invention the fuel-oxygen containing gas passes through the upper portions of the catalyst bed where the fuel is oxidized. Water pumped down a central concentric tube in the porous bed is forced through perforations into the heated porous bed. The heated exhaust gas and steam formed from the water in the hot bed flows concurrently out the bottom of the bed through a porous retaining plate and moves together into the hydrocarbon bearing formation. The $CO_2$ in the exhaust gas dissolves in the hydrocarbon to swell the oil and further reduce its viscosity. Oxygen remaining in the exhaust gas may cause burning within the formation to give a combination forward combustion and steam drive. However, the exhaust gas from the producing wells may be more or less recycled to prevent any combustion from occurring with the formation. This second embodiment of the steam generator is flexible in its operation in that a variety of fluids may be injected with only a change in surface injection. For example, cold water may be injected or only hot flue gas, or hot flue gas denuded of oxygen with steam or hot water with flue gas, or only hot exhaust gas containing sufficient oxygen to cause combustion or hot exhaust gas with remaining oxygen and steam.

Suitable fuels for use in this invention include those fuel gases which will oxidize at the desired temperature of 70 to 3000 degrees F or more, depending on the materials of construction for the generator, such as methane, methanol, propane, etc. and other light hydrocarbons or hydrogen. A particular fuel-catalyst combination may be selected. For example, exhaust gas from an internal combustion engine has about 6% carbon monoxide gas which will further burn to carbon dioxide to produce sufficient heat to drive the steam generator. In this case a manganese dioxide-cupric oxide catalyst might be used to oxidize CO even at lower temperatures. Other low heating value gases which would normally be discarded may be used to fire this steam generator. The fuel content of the fuel-oxygen containing gas mixture will usually have a heating value in the range of 5 to 80 BTU/scf. For example 3% methane with air will produce a burning temperature about 1600 degrees F. Since the lower combustion limit for methane in air is 4 or 5 percent methane, the 3% methane of this example would not be considered explosive in its movement down the pipe to the generator. Liquid fuels may be used by running an auxiliary line to the top of the porous catalyst bed where the fuel is atomized or the liquid fuel as an auxiliary fuel could be atomized into the lower section of the bed where the water enters in the second embodiment of the invention.

BRIEF DESCRIPTION OF THE DRAWINGS

This invention will now be described more particularly with reference to the accompanying drawing wherein:

Referring now to FIG. 1, a steam generator designated generally as 2 is shown positioned within a casing 4 cemented into a well bore which penetrates a hydrocarbon bearing formation 6. The steam generator 2 generally comprises four concentric tubes designated 8, 10, 12 and 14 from the inner to outer tubes respectively. Each of these tubes is made from heat resistent metal or ceramic material according to the particular application. Tubes 8 and 12 are adapted to be connected by means of collars 16 and 18 to normal steel tubing members 20 and 22 which extend to the ground surface. A catalyst bed 24 is contained in the annulus between tubes 10 and 12 and supported at the bottom by an annular porous plug 26. A crossover arrangement 28 is provided to place the tube 8 in communication with the annulus between tubes 10 and 12 and to seal the bottom of tube 8 and the annulus between tubes 10 and 12. By this arrangement, a suitable gas containing a fuel-oxygen mixture may be conducted by means of tube 8, the crossover 28 and the annulus between tubes 10 and 12 to the porous plug 26 through which it may flow to enter the catalyst bed 24 where combustion may occur. The top of catalyst bed 24 is in communication with the annulus between tubes 8 and 12 so that the products of combustion are carried back to the surface.

Figure 1:
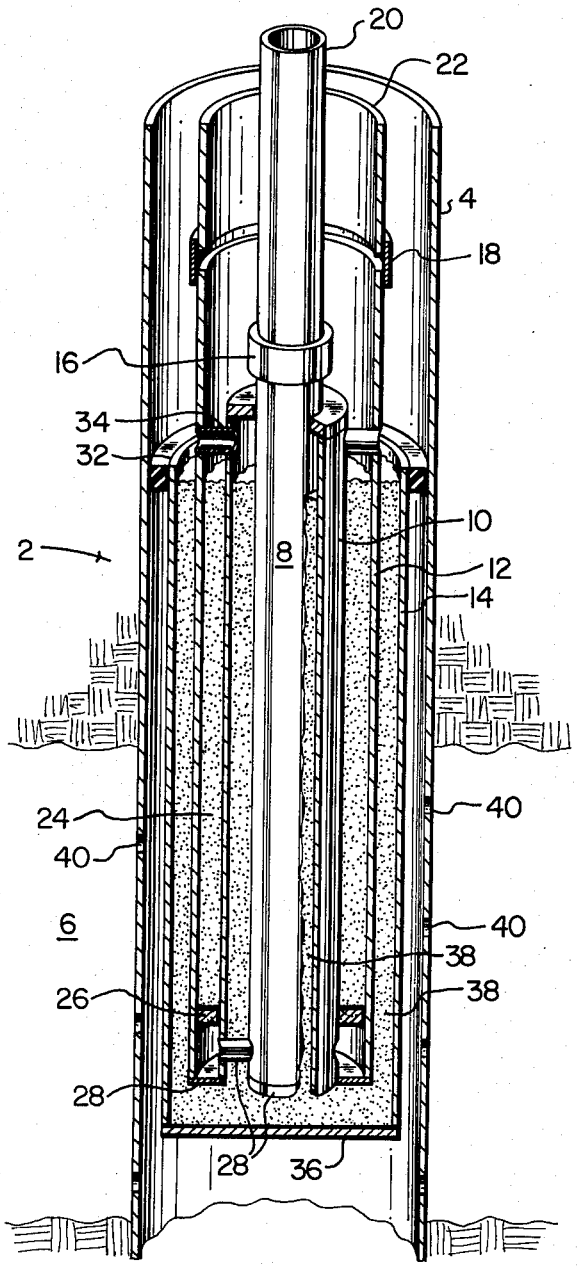
FIG. 1 is a sectional view of a first embodiment of the present invention.

A packer assembly 32 is provided on tubes 12 and 14 to hold tube 14 onto tube 12 and to also provide a seal between the tube 14 and the casing 4. A crossover 34 is also provided to place the annulus between tube 12 and casing 4 in communication with the annulus between tubes 8 and 10 and with the annulus between tubes 12 and 14. The bottom of tube 14 is sealed with a porous plug 36. A porous bed 38 of sand or other particulate matter fills the double annulus between tubes 8 and 10 and between tubes 12 and 14. This double annulus provides a complete jacket around the catalyst bed 24. The top of the double annulus is in communication with the annulus between tubing string 22 and the casing 4 so that water may be pumped from the surface into the double annulus. The bottom of the double annulus is closed by the porous plug 36 so that steam generated within the bed 38 may be exhausted into the lower portion of casing 4 which is sealed from the upper portion by the packer 32. A number of perforations 40 through casing 4 in the hydrocarbon zone 6 allow steam from steam generator 2 to enter the hydrocarbon formation for the enhanced recovery process.

In operation the generator 2 is lowered into the bore hole and positioned so the bottom of the generator is opposite the perforations 40 in the casing 4. The packer 32 is set to close the casing 4 to permit gases to move into the formation 6. After suitable connections have been made at the surface, a fuel-oxygen containing gas is introduced through tube 8, which permits its passage through the oxidation catalyst containing porous bed 24, where the fuel is oxidized releasing heat. The porous bed 24 reaches an elevated temperature controlled by the fuel content of the fuel-oxygen containing gas. The hot catalyst bed 24 transfers heat to tubes 10 and 12 and to the porous bed 38 by conduction. Water pumped down the annulus between tube 22 and casing 4 and into porous bed 38 is heated by contact with tubes 10 and 12 and the porous bed 38 itself. The water vaporizes into steam which passes out the porous plate 36, through the perforations 40 into the hydrocarbon bearing formation 6 to force the oil to a producing well bore nearby.

Figure 2:
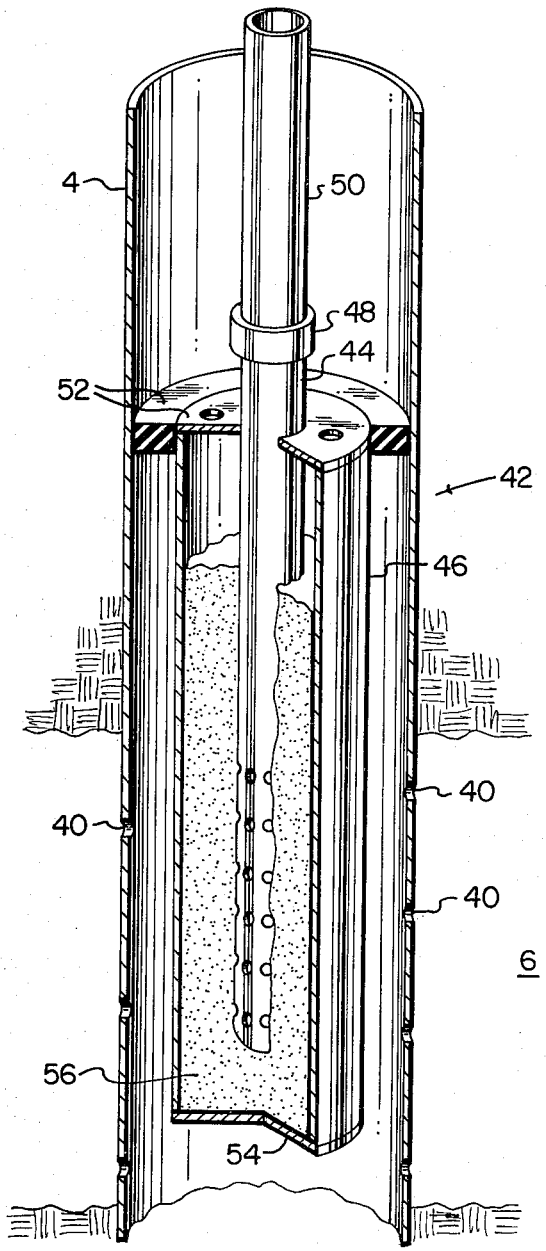
FIG. 2 is a sectional view of a second embodiment of the present invention.

FIG. 2 represents a second and somewhat simpler embodiment of the present invention. A steam generator shown generally at 42 comprises basically inner and outer concentric tubes 44 and 46. These tubes may be made of high temperature steel or ceramic material according to the designed operating temperatures. Tube 44 is connected by means of a collar 48 to a normal steel tubing string 50 extending to the earth's surface. The outer tube 46 may be connected to the inner tube 44 by a packer assembly 52 which also provides a seal between the outer tube 46 and a well casing 4 which penetrates a hydrocarbon bearing formation 6 as discussed with reference to FIG. 1. The annulus between tubes 44 and 46 is in communication with the annulus between tubing string 50 and the casing 4. The lower end of tubing 46 is closed by a porous plug 54 which supports a catalyst bed 56 within the annulus between tubes 44 and 46. The lower end of tube 44 is perforated within the catalyst bed 56 preferably only in the lower portion thereof.

In operation, the generator 42 is run to near the bottom of the hole opposite the formation 6, on the tubing string 50. The packer 52 is expanded to seal the casing 4 to pipe 46 annulus. Fuel-oxygen containing gas is made to pass down the annulus between tube 50 and casing 4 through the catalyst containing bed 56 where it combusts heating the gases and bed to an elevated temperature. Water is pumped down the tube 50 and through the perforations in tube 44, into the heated porous matrix 56 where it is vaporized into steam. The exhaust gases and steam flow concurrently down through the porous bed 56, out the porous plate 54, and through perforations 40 into the formation 6 to remove the hydrocarbons therefrom.

As noted above, the oxidizing catalyst is not always needed in an entire porous bed. The FIG. 2 embodiment provides an example where the porous bed 56 would conveniently contain oxidizing catalyst only in that portion above the perforations in tube 44. Thus while porous bed 56 is continuous, it may actually comprise two distinct regions or beds similar to the FIG. 1 embodiment. The upper portions of bed 56 can be considered to actual heat generator like bed 24 of FIG. 1, while the lower portion vaporizes water like bed 38 of FIG. 1.

Figure 3:
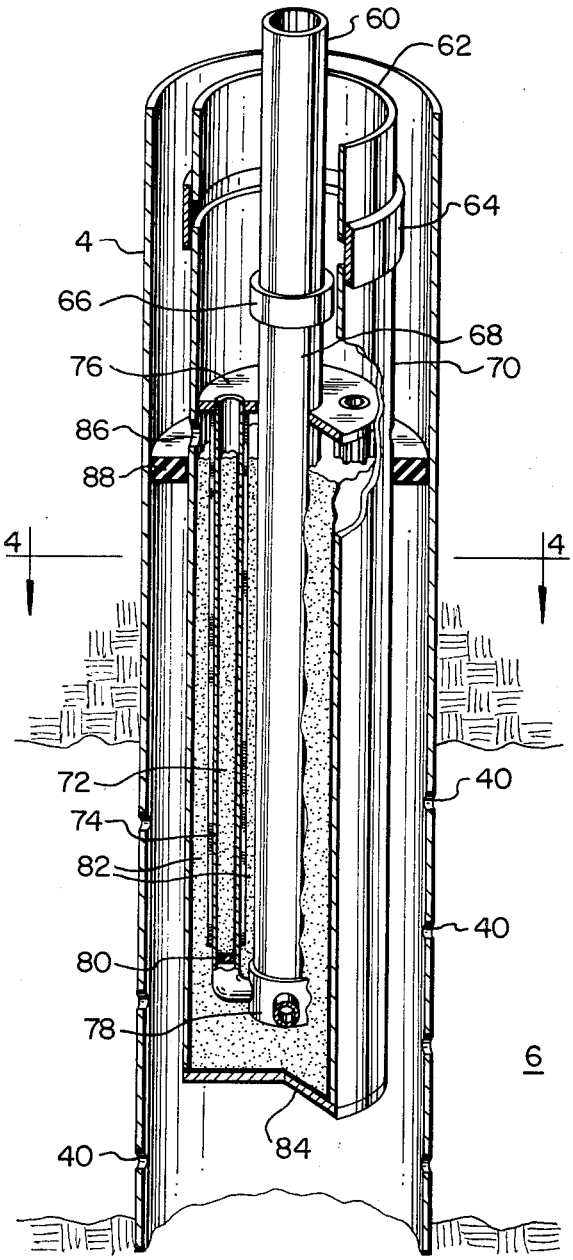
FIG. 3 is a sectional view of yet another embodiment of the present invention.

With reference now to FIG. 3, there is illustrated yet another embodiment of the present invention in which two porous beds are physically isolated from each other. Several modifications are provided to the FIG. 3 embodiment to improve the heat transfer between the catalyst bed and steam generating bed. As with the other embodiments, the steam generator of FIG. 3 is illustrated within a casing 4 which penetrates hydrocarbon bearing zone 6. As with the FIG. 1 embodiment, the steam generator is supported from the earth's surface by a double tubing string comprising inner string 60 and outer string 62. These strings are connected by means of collars 64 and 66 to sections of tubing 68 and 70 which comprise the main part of the steam generator of FIG. 3. In this embodiment, a catalyst bed 72 is contained within four additional sections of tubing 74, two of which are illustrated in this cross-sectional view. The sections of tubing 74 are supported at their top by plate 76 extending from tube 68 to tube 70, thereby forming a manifold placing the tubes 74 in communication with the annulus between tubes 68 and 70 for return of exhaust gases. A crossover or manifold arrangement 78 connects the lower end of tubing 68 with each of the tubes 74. Also, at the lower end of each tube 74 is a small porous plug 80 supporting the catalyst bed 72. The remaining space within tubing 70 is filled with a porous bed 82 for receiving heat from the catalyst bed 72 and generating steam. This porous bed 82 is supported by porous plug 84 at the lower end of tubing 70. Tubing 70 also has perforations 86 for allowing water passing down the annulus between casing 4 and tubing string 62 to enter the porous bed for steam generation. A packer 88 is provided to seal the annulus between string 70 and well casing 4 below the perforations 86 so that the steam passing through porous plate 84 is directed through perforations 40 to the hydrocarbon bearing zone 6.

In operation, the FIG. 3 embodiment is essentially identical to the FIG. 1 embodiment. A fuel-gas oxygen mixture is pumped down tubing string 60 and through manifold 78 to the lower end of each of the tubes 74. Upon contact with the catalyst bed 72, the fuel gas is burned, generating heat which passes through the tubes 74 to the porous bed 82. The exhaust gases from the catalyst bed 72 pass out the top of tubes 74 into the annulus between tubes 60 and 62 and are conducted thereby to the surface. Water is pumped down the annulus between tube 64 and casing 4 through perforations 86 in tubing 70 and into the porous bed 82. The water is converted to steam which passes through porous plug 84 and into the oil bearing formations.

Figure 4:
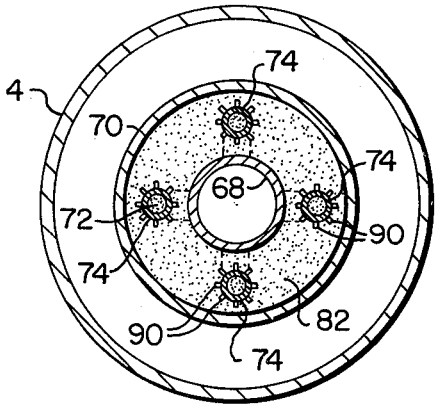
FIG. 4 is a cross section of FIG. 3.

FIG. 4 is a cross-sectional view of the FIG. 3 embodiment and illustrates one further improvement which will further increase the heat transfer between the catalyst bed and the porous steam generating bed. In particular, in FIG. 4, the catalyst bed tubings 74 each carry a number of radially extending fins 90 which help spread the heat from the catalyst bed out into the porous steam generating bed 82. It is apparent that fins on the outside of tubes 74 would also improve the transfer of heat from the catalyst bed 72 to the steam generating bed 82. Such a fin arrangement would also be useful in the FIG. 1 embodiment.

While the present invention has been illustrated in terms of specific apparatus, it is apparent that various modifications may be made within the scope of the invention as defined by the appended claims.

I claim:

1. A steam generator for use in a borehole comprising:

first and second porous beds in thermal communication with each other, said first bed containing oxidizing catalyst in at least a portion thereof, means for conducting fuel and oxidizing gas to and into contact with said first bed, means for conducting water to said second bed, and means for exhausting steam from said second bed.

2. A steam generator for use in a borehole comprising:

first and second concentric tubes and a first porous bed carried between said first and second tubes, said first bed containing oxidizing catalyst in at least a portion thereof;

a third tube concentric with said second tube and a second porous bed carried between said second and third tubes;

means for conducting fuel and oxidizing gas to said first bed;

means for conducting water into second bed; and means for exhausting steam from said second bed.

3. A steam generator according to claim 2, wherein said first tube is said means for conducting fuel and oxidizing gas to said first bed, and said first bed is open at its upper end to allow venting of products of combustion;

further including; a porous plug closing the bottom of an annulus between said second and third tubes and supporting said second bed, said porous plug comprising said means for exhausting steam; and means for separating said products of combustion from said steam.

4. A steam generator for use in a borehole comprising:

first and second concentric tubes defining an annulus therebetween and a porous plug closing the bottom of said second tube;

first and second porous beds carried within vertically separate portions of said annulus and supported by said porous plug, said first bed containing oxidizing catalyst in at least a portion thereof;

means for conducting fuel and oxidizing gas to said first bed;

means for conducting water into said second bed; and means for exhausting steam from said second bed, said means for exhausting including said porous plug.

5. A steam generator according to claim 4, wherein:

said first bed is above said second bed; said annulus is said means for conducting fuel and oxidizing gas to said first bed; said first tube is perforated adjacent the second bed; and said first tube comprises said means for conducting water into said second bed.

6. A steam generator for use in a borehole comprising:

a first tube and a porous plug closing a lower end of said first tube;

a second tube carried within said first tube and having a lower end adjacent said porous plug;

a plurality of third tubes carried between said first and second tubes, each of said third tubes having a lower end in communication with the lower end of said second tube and an upper end in communication with a manifold in common with all of said third tubes;

a first porous bed containing oxidizing catalyst in at least a portion thereof and carried within said third tubes;

a second porous bed carried within the space between said first, second and third tubes and supported by said porous plug;

means for conducting fuel and oxidizing gas to said first bed;

means for conducting water into said second bed; and means for exhausting steam from said second bed including said porous plug.

7. A steam generator according to claim 6 wherein said means for conducting fuel and oxidizing gas includes said second tube.

8. A steam generator according to claim 6 further including fins extending from the surfaces of said third tubes for improving heat transfer between said first and second porous beds.

* * * * *

UNITED STATES PATENT AND TRADEMARK OFFICE

CERTIFICATE OF CORRECTION

PATENT NO. : 4,237,973

DATED : December 9, 1980

INVENTOR(S) : John C. Todd

It is certified that error appears in the above-identified patent and that said Letters Patent are hereby corrected as shown below:

Column 6, line 11, delete "and" (second occurrence)

Column 6, line 12, delete "into contact with"

Column 6, line 13, after "to", insert --and into contact with--

Signed and Sealed this

*Seventeenth* Day of *March 1981*

[SEAL]

*Attest:*

RENE D. TEGTMEYER

*Attesting Officer* *Acting Commissioner of Patents and Trademarks*